US006331219B1

(12) United States Patent
Shore et al.

(10) Patent No.: US 6,331,219 B1
(45) Date of Patent: Dec. 18, 2001

(54) RETARDED COOLING SYSTEM WITH GRANULAR INSULATION MATERIAL

(75) Inventors: T. Michael Shore, Princeton; Melicher Puchovsky, Dudley, both of MA (US)

(73) Assignee: Morgan Construction Company, Worcester, MA (US)

( * ) Notice: Subject to any disclaimer, the term of this patent is extended or adjusted under 35 U.S.C. 154(b) by 0 days.

(21) Appl. No.: 09/392,112

(22) Filed: Sep. 8, 1999

Related U.S. Application Data

(60) Provisional application No. 60/103,657, filed on Oct. 9, 1998.

(51) Int. Cl.[7] ..... B21B 43/00

(52) U.S. Cl. ..... 148/589; 148/630; 148/658

(58) Field of Search ..... 148/589, 630, 148/626, 658

(56) References Cited

U.S. PATENT DOCUMENTS

| | | | | |
|---|---|---|---|---|
| 3,276,920 | * | 10/1966 | Sims | 148/14 |
| 3,320,101 | | 5/1967 | McLean et al. . | |
| 3,378,248 | | 4/1968 | Krahe et al. . | |
| 3,506,468 | * | 4/1970 | Geipel et al. | 148/12.4 |
| 3,525,507 | | 8/1970 | Geipel et al. . | |
| 3,930,900 | | 1/1976 | Wilson . | |
| 3,940,961 | | 3/1976 | Gilvar . | |
| 4,382,586 | | 5/1983 | Reese . | |
| 4,410,373 | | 10/1983 | Kemp . | |
| 4,468,262 | | 8/1984 | Kaneda et al. . | |
| 4,591,335 | | 5/1986 | Buxel et al. . | |
| 4,800,949 | | 1/1989 | Bak et al. . | |
| 4,861,394 | | 8/1989 | Colin et al. . | |
| 5,101,652 | | 4/1992 | Burk et al. . | |

FOREIGN PATENT DOCUMENTS

| | | |
|---|---|---|
| 81035A | 9/1980 | (FR) . |

* cited by examiner

*Primary Examiner*—George Wyszomierski
*Assistant Examiner*—Janelle Combs-Morillo
(74) *Attorney, Agent, or Firm*—Samuels, Gauthier & Stevens

(57) ABSTRACT

A system for cooling a hot rolled steel product at a retarded cooling rate comprises a laying head for forming the product into a continuous series of rings. A conveyor receives the rings from the laying head at a receiving station and transports the rings in a non-concentric overlapping pattern through a cooling zone to a reforming station at which the rings are delivered from the conveyor and gathered into upstanding coils. The rings are covered with a granular insulation material while being transported through the cooling zone.

13 Claims, 3 Drawing Sheets

RETARDED COOLING SYSTEM WITH GRANULAR INSULATION MATERIAL

PRIORITY INFORMATION

This application claims priority from provisional application Serial No. 60/103,657 filed Oct. 9, 1998.

BACKGROUND OF THE INVENTION

1. Field of the Invention

This invention relates to rolling mills producing hot rolled steel products such as rods, bars and the like, and is concerned in particular with an improved system and method for cooling such products at retarded cooling rates.

2. Description of the Prior Art

It is known to form hot rolled steel rod into rings which are deposited on a conveyor and transported through cooling zones where the rod is cooled at controlled rates in order to achieve desired metallurgical properties. Cooling rates may be accelerated through the forced application of a gaseous coolant, typically ambient air, or the cooling rates may be retarded through the use of insulated covers overlying the conveyor. Examples of the foregoing are disclosed in U.S. Pat. No. 3,320,101 (McLean et al.); U.S. Pat. No. 3,930,900 (Wilson); U.S. Pat. No. 3,940,961 (Gilvar) and U.S. Pat. No. 4,468,262 (Kaneda et al.).

One drawback of such installations is that prolonged exposure of the rings to ambient air encourages the development of surface scale, which must then be removed before the product can be subjected to further processing e.g., wire drawing, machining, etc. Also, cooling rates tend to be non-uniform and somewhat difficult to control.

Other attempts at more uniform retarded cooling have included the use of hot water baths and fluidized beds, but these have not proven to be commercially viable.

SUMMARY OF THE INVENTION

The objective of the present invention is to overcome the drawbacks associated with the above described prior art systems by embedding the rings being transported on the conveyor in granular insulation material. By doing so, exposure of the ring surfaces to ambient air is significantly minimized, with a concomitant reduction in the development of surface scale. Collateral advantages include more uniform cooling, and an ability to more closely control cooling rates, for example by either heating or cooling the granular insulation material prior to its application to the product rings.

BRIEF DESCRIPTION OF THE DRAWINGS

These and other objects and advantages will now be described in greater detail with reference to the accompanying drawings, wherein.

DETAILED DESCRIPTION OF PREFERRED EMBODIMENTS

Figure 1:
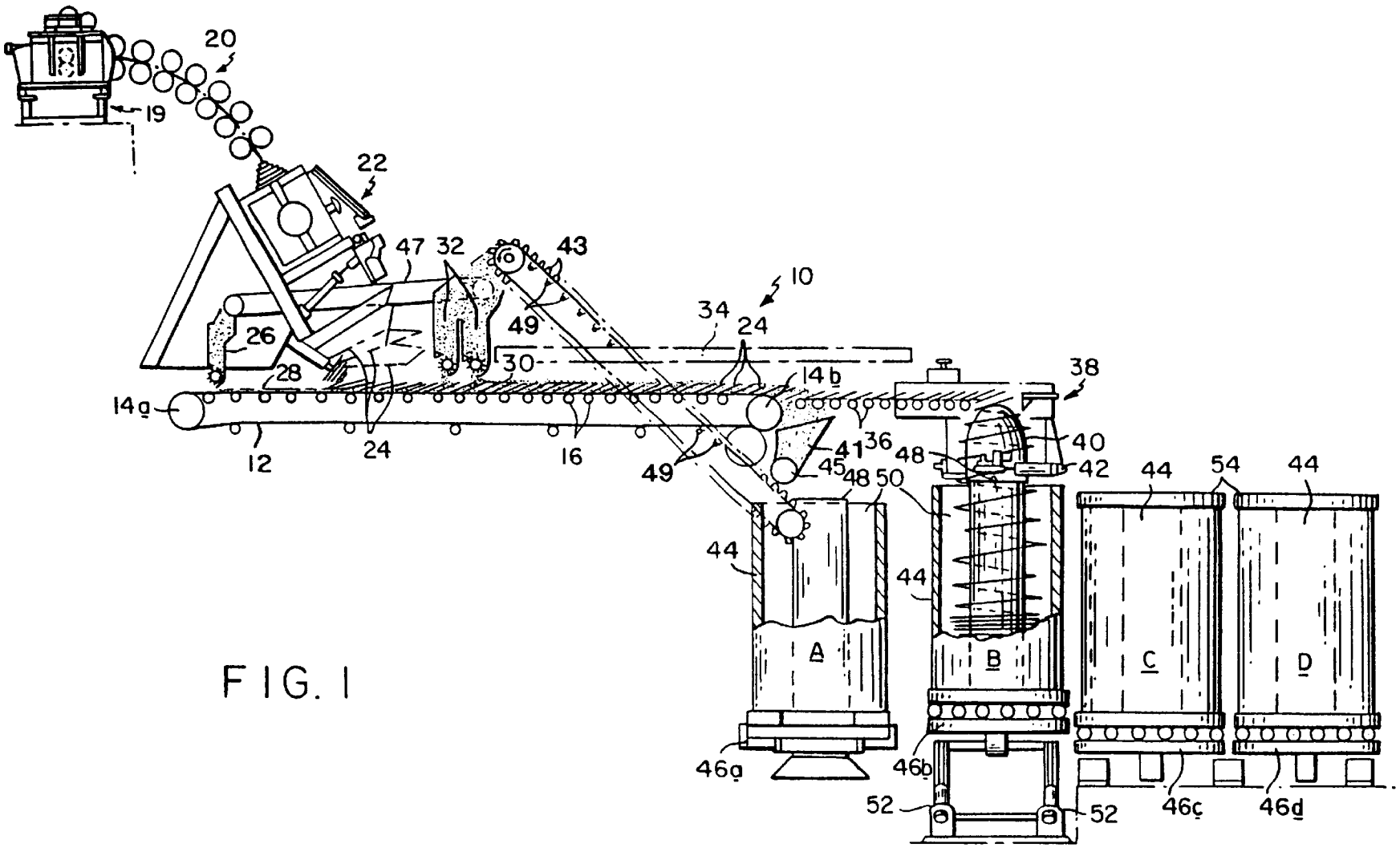
FIG. 1 is an illustration of one embodiment of a system in accordance with the present invention.
Figure 2:
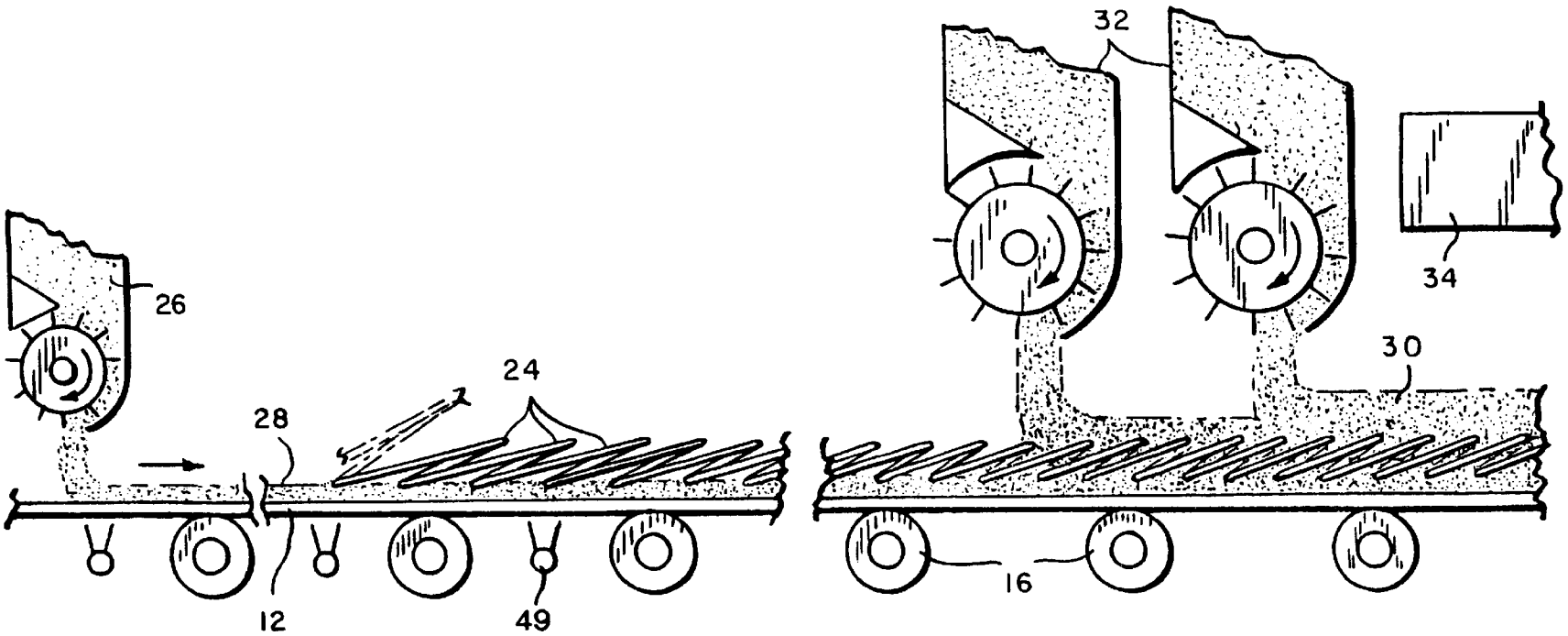
FIG. 2 is an enlarged view of a portion of the system shown in FIG. 1.

With reference initially to FIGS. 1 and 2, one embodiment of a retarded cooling system in accordance with the present invention is generally depicted at 10. A continuous belt 12 of sheet steel or other appropriate heat resistant material extends between rolls 14*a*, 14*b*, at least one of which is driven by a conventional drive (not shown) to move the upper belt portion from left to right as viewed in the drawing. The belt is supported at spaced locations between the rolls 14*a*, 14*b* by rollers indicated typically at 16, which also may be driven.

Hot rolled steel rod is received from a rolling mill and directed downwardly by a pinch roll unit 19 and rollerized guide mechanism 20 to a laying head 22 which forms the rod into a continuous series of rings 24. Immediately upstream from the laying head 22, a feeder mechanism 26 deposits a base layer 28 of a preheated granular insulation material on the belt 12. The insulation material may typically comprise dolomite, silica, sand or the like having an average grain or particle size ranging from about 1 to 8 mm.

The rings 24 emerging from the laying head 22 are deposited in an overlapping non-concentric pattern on the insulation base layer 28, and are immediately covered by a top layer 30 of preheated granular insulation material applied by second feeder mechanisms 32.

Typically, the rod rings will be laid on the conveyor at an elevated temperature above about 500° C., and the granular insulation will be preheated to ±100° C. of that laying temperature, thereby resulting in the rod being cooled on the conveyor at a retarded rate on the order of 0.05 to 1° C./sec. It will be understood, of course, that this is but one of a myriad of different retarded cooling processes that may be carried out with the disclosed system. Cooling rates will vary depending on the temperature of the rod being laid on the conveyor, the temperature and/or type of granular insulation, and other factors, including the optional use of insulating covers 34 or the like to further retard cooling. Under certain conditions, it may be desirable to cool rather than preheat the granular insulation material.

At the delivery end of the conveyor, the rings 24 pass over driven mutually spaced rollers 36 before being received in a reforming chamber 38 where they are gathered into upstanding cylindrical coils. The granular insulation material drops between the rollers 36 into a hopper 41. An auger 45 moves the insulation material laterally from the hopper to a bucket conveyor 43 or other like conveying mechanism which serves to recirculate the granular insulation material back to the feeder mechanism 32, and via an auxiliary conveyor 47 to the feeder mechanism 26.

Although the granular insulation material will be continuously reheated by the heat given off by the rings on the conveyor, some additional reheating may be required, and to this end heaters 49 may be provided along the path of the conveyor 43 and/or beneath the belt 12.

The upper end of the reforming chamber 38 is of a known design, as disclosed for example in U.S. Pat. No. 5,501,410 (Starvaski) and U.S. Pat. No. 5,735,477 (Shore et al.), and includes a nose cone 40 suspended by an iris mechanism 42 which may be moved into and out of the path of ring descent. Insulated pots 44 are movable on driven roller conveyor segments 46*a*–46*d* from a waiting station "A" to a coil receiving position "B" at the reforming chamber 38, and from there to a holding station "C". Each pot has an inner core 48 which cooperates with a surrounding insulated wall to define an annular chamber 50. Piston-cylinder units 52 are operable to elevate the roller conveyor segment 46*b*, thereby raising the pot 44 supported thereon to place its core 48 in supportive contact with the nose cone 40. This frees the iris mechanism 42 for retraction, thereby allowing rings to descend over the nose cone 40 and into the annular chamber 50 of the underlying pot for collection into a coil.

At the conclusion of a coil forming operation, the iris mechanism 42 is closed and the conveyor segment 46*b* is lowered, resulting in the nose cone 40 being redeposited on the iris. The filled pot is then shifted to the holding station C where it is covered by a lid 54. At the same time, another empty pot is moved into the coil receiving position B and the entire operation is repeated.

Figure 3:
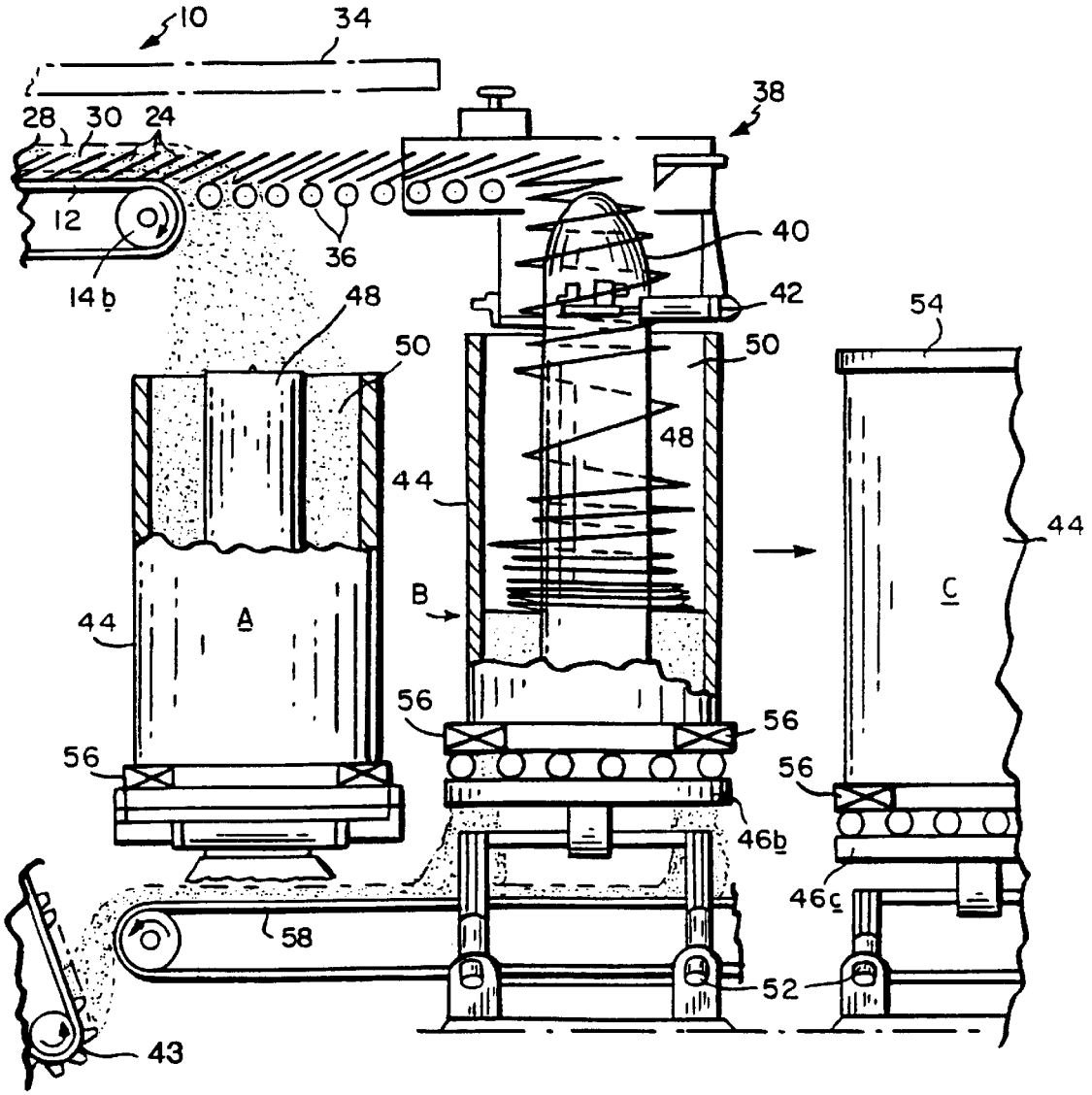
FIG. 3 is an illustration of an alternative system in accordance with the present invention.

In an alternative embodiment of the present invention as depicted in FIG. 3, the granular insulation material dropping between the spaced rollers 36 is directed downwardly into the annular chamber 50 of a pot at the waiting station A. The filled pot is then shifted to the coil receiving position B, and its place at the waiting station A is taken by another empty pot (not shown).

In this embodiment, the pots are provided with gate mechanisms 56 at the bottoms of the annular chambers 50. During the coil forming operation, the gate mechanism of the pot at the receiving position B is opened to control the discharge of granular insulation material downwardly through the spaced rollers of the conveyor segment 46*b* onto a conveyor belt 58 for return to the bucket conveyor 43. The gradually lowering level of the granular insulation in the pot chamber 50 serves as a descending coil support which maintains the top of the accumulating coil at a relatively constant level.

In light of the foregoing, it will be appreciated that the present invention offers a number of significant advantages not available with prior art systems. Of particular importance is the immediate embedding of the rings 24 emerging from the laying head 22 in the granular insulation material. By doing so, the development of surface scale is significantly minimized, while at the same time making it possible to achieve a more uniform and controllable rate of retarded cooling.

At the end of the retarded cooling cycle on the conveyor, the granular insulation material can either be recovered and recirculated back to its initial points of application, or it can serve a continued support function in the insulated pots being employed at the reforming chamber.

It will now be apparent to those skilled in the art that the embodiments herein chosen for purpose of disclosure are susceptible to modification by substituting structurally and functionally equivalent steps and/or components. By way of example only, and without limitation, other systems including those that are pneumatically driven, may be employed to recirculate the granular insulation material. The length, design and configuration of the conveyor can be modified to suit the requirements of various installations. Insulated covers on the conveyor are optional, as are the heaters which may be employed to reheat the granular insulation material at various stages during the retarded cooling, recovery and recirculation cycles.

It is my intention to cover these and all other changes and modifications which do not depart from the spirit and scope of the invention as defined by the claims appended hereto.

We claim:

1. A method of cooling a hot rolled steel product at a retarded cooling rate, said method comprising:

forming the product into a continuous series of rings;

depositing said rings on a conveyor at a receiving station and transporting said rings in a non-concentric overlapping pattern from said receiving station through a cooling zone to a reforming station where the rings are delivered from the conveyor and gathered into upstanding coils; and embedding the rings being transported through said cooling zone in a layer of granular insulation material.

2. The method as claimed in claim 1 wherein a first layer of said granular insulation material is deposited on said conveyor at a location upstream of said receiving station to thereby underlie the rings being deposited on said conveyor, and wherein a second layer of said granular insulation material is deposited on said conveyor at a location downstream of said receiving station, whereupon said rings are embedded in said granular insulation material.

3. The method as claimed in claim 1 further comprising the step of separating said granular insulation material from said rings at a location upstream of said receiving station.

4. The method as claimed in claim 3 further comprising the step of recovering and recirculating the thus separated granular insulation for reuse in embedding the rings being transported through said cooling zone.

5. The method as claimed in claim 4 further comprising the step of reheating the granular insulation material being recirculated.

6. The method as claimed in claim 3 further comprising the step of containing the upstanding coils being formed at said receiving station in insulated pots.

7. The method as claimed in claim 6 wherein prior to being positioned at said receiving station, said pots are filled with the thus separated granular insulation material, and said granular insulation material is thereafter gradually withdrawn from said pots at said receiving station, the rate of withdrawal of said granular insulation material being related to the rate at which said pots receive rings from said conveyor.

8. The method as claimed in claim 7 further comprising the step of recovering the thus withdrawn granular insulation material for recirculation and reuse in embedding the rings being transported through said cooling zone.

9. The method as claimed in claim 8 further comprising the step of reheating the granular insulation material being recirculated.

10. The method as claimed in claim 1 wherein said rings are deposited on said conveyor at a laying temperature above about 500° C.

11. The method of claim 10 wherein prior to embedding said rings, said granular insulation material is preheated to a temperature of +100° C. of said laying temperature.

12. The method of claim 11 wherein said rings are cooled at a retarded rate on the order of 0.05 to 1° C./sec.

13. The method of claim 1 wherein said granular insulation material is selected from the group consisting essentially of dolomite, sand, silica, and the like.

* * * * *